United States Patent [19]

Nishimura et al.

[11] 3,998,046

[45] Dec. 21, 1976

[54] ELECTRONIC TIMEPIECE

[75] Inventors: Izuhiko Nishimura, Suwa; Shinju Morozumi, Shimosuwa, both of Japan

[73] Assignee: Kabushiki Kaisha Suwa Seikosha, Tokyo, Japan

[22] Filed: June 12, 1973

[21] Appl. No.: 369,340

[30] Foreign Application Priority Data

June 12, 1972 Japan ..... 47-58477

[52] U.S. Cl. ..... 58/23 R; 58/85.5

[51] Int. Cl.[2] ..... G04C 3/00

[58] Field of Search ..... 58/23 R, 23 A, 85.5, 58/50

[56] References Cited

UNITED STATES PATENTS

| | | | |
|---|---|---|---|
| 3,541,779 | 11/1970 | Langley | 58/23 R |
| 3,668,859 | 6/1972 | Polin et al. | 58/85.5 |
| 3,678,680 | 7/1972 | Fujita | 58/23 R |
| 3,733,810 | 5/1973 | Girard | 58/23 R |

*Primary Examiner*—Ulysses Weldon
*Attorney, Agent, or Firm*—Blum, Moscovitz, Friedman & Kaplan

[57] ABSTRACT

An electronic timepiece having a pulse generator producing a high frequency time standard signal, a divider circuit formed from a plurality of series-connected divider stages for producing low frequency timing signals in response to said time standard signal and a device for digitally displaying time in response to said timing signals, is provided with a correction circuit disposed in said divider circuit. The correction circuit allows a correction signal to be combined with a carry signal from a higher frequency divider stage to the next subsequent lower frequency divider stage to advance the pulse rate, thereby correcting the timing signals supplied to the device for digitally displaying time.

10 Claims, 9 Drawing Figures

ELECTRONIC TIMEPIECE

BACKGROUND OF THE INVENTION

This invention relates to electronic timepieces incorporating digital displays, and in particular, to small sized electronic timepieces such as wristwatches. While electronic timepieces such as wristwatches, have become known for their extreme accuracy, it is necessary at times to make corrections in the time displayed. Because the wristwatches are limited in the space provided for the electronic circuitry, correction circuits which have heretofore been suggested, have not provided the accuracy and the minimal space displacement which is necessary in such watches. Accordingly it is desirable to produce a small sized digital electronic timepiece, particularly a wristwatch which can be corrected by the addition of a correction signal to the counting circuit of the watch.

SUMMARY OF THE INVENTION

Generally speaking, in accordance with the invention, an electronic timepiece is provided including pulse generator means for generating a high frequency time standard signal, divider means formed from a plurality of series connected divider stages for producing low frequency timing signals in response to said time standard signal and representative of present time, and digital display means for the digital display of time in response to said timing signals. A correction circuit is provided intermediate a pair of said divider stages for correcting the frequency of the standard signal by combining a selectively-applied correction signal with a carry signal representing the output signal of the higher frequency divider stage of said pair, the output of the correction circuit being supplied as the input to the lower frequency divider stage of said pair.

The correction circuit may take the form of an EXCLUSIVE OR gate. A further embodiment includes the use of a master-slave flip-flop device controlled by the output of a divider stage of a higher frequency than the frequencies of said pair of divider stages for supplying the carry and/or correction signal to the correction circuit.

Accordingly, it is an object of this invention to provide a small sized electronic timepiece provided with a digital display and having an improved correction circuit.

Still another object of the invention is to provide an improved small sized electronic timepiece wherein correction of the time displayed thereby is achieved in response to each application of a correction signal.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which.

DESCRIPTION OF THE PREFERRED EMBODIMENTS

Figure 1:
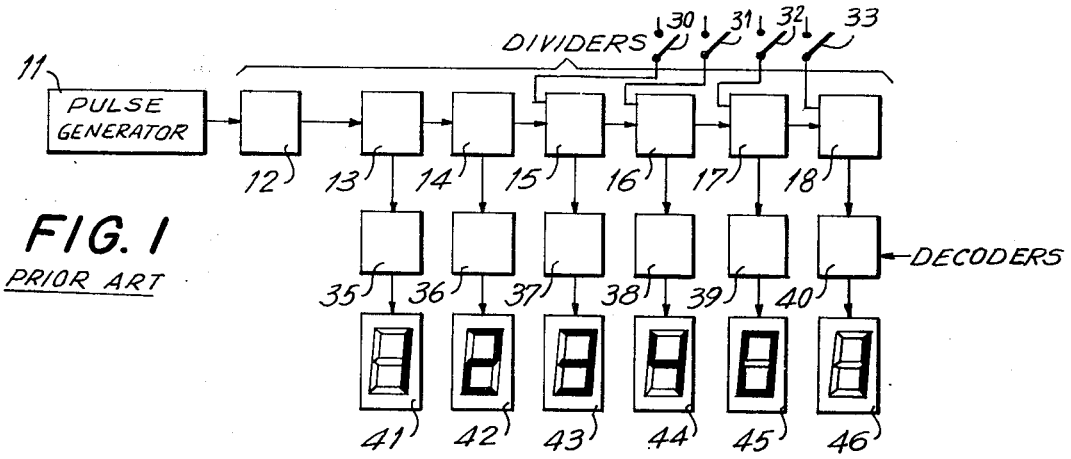
FIG. 1 PRIOR ART
FIG. 1 is a block diagram of a conventional electronic timepiece.

Referring to FIG. 1, the conventional electronic timepiece depicted includes a pulse generator 11 for producing a high frequency time standard signal. The pulse generator may take the form of a quartz crystal oscillator or the like. The time standard signal output of pulse generator 11 is applied to a divider circuit 12 which consists of a divider chain which divides the signal into either a one minute or a one second signal, depending on the digits of time to be displayed. Thus, if the seconds are to be displayed, as in the embodiment depicted, then the divider circuit 12 would produce a one-second signal having a period of one second. The one-second signal from the divider circuit 12 is applied to a series chain of divider circuits 13 through 18 which produce the timing signals. Thus, divider circuit 13 is a one-tenth divider circuit for producing a ten-second signal; divider circuit 14 is a one-sixth divider for producing a one-minute signal; divider circuit 15 is a one-tenth divider circuit for producing a ten-minute signal; divider circuit 16 is a one-sixth divider circuit for producing a one-hour signal; divider circuit 17 is a one-tenth divider for producing a ten-hour signal and divider circuit 18 is a binary or a one-third divider for producing a resetting signal at a count of 12 or 24 hours as desired. One of external correcting switches 30, 31, 32 and 33 is connected to each of divider circuits 15, 16, 17 and 18 for the separate correction thereof as described below.

Divider circuits 13 through 18 each also produces instantaneous timing signals counted therein for application to decoders 35 through 40 which correspond respectively to the divider circuits 13 through 18. Decoder circuits 35 through 40 translate the timing signals from the divider circuits into a format suitable for driving the respective digits 41 through 46 of the digital display means. In the embodiments of the invention depicted in the drawings, each of said digits consists of a seven bar display, the corresponding decoder circuit being adapted to produce the appropriate drive signals required to energize the combination of bars of each digit required to digitally display the value of the respective instantaneous timing signals from divider circuits 13 through 18. Thus, if divider circuit 13 has counted one one-second signal, this information is transmitted to decoder 35 which excites only the two right-most vertical bars of digit 41, as shown in FIG. 1. Similarly, digit 42 is excited by the count of the ten-second signal from divider circuit 14; digit 43 is excited by the count of the one-minute signal from divider circuit 15; digit 44 is excited by the count of the ten-minute signal from divider circuit 16; digit 46 is excited by the count of the one-hour signal from divider circuit 17; and digit 46 is controlled by the count of the ten-hour signal from the divider circuit 18; digits 41 through 46 being depicted in inverse order in FIG. 1.

The digital display devices incorporated in the electronic timepiece according to the invention may be formed from liquid crystal devices, light emitting diodes or other low powered digital displays.

As is appreciated by the skilled artisan, the divider circuits 13 through 18 are counting circuits. Thus, as hereinabove mentioned, the divider circuit 12 has a one-second output signal which is applied to divider circuit 13 which is a one-tenth divider circuit. Thus, divider circuit 13 counts to 10 and upon the tenth one-second signal sends a ten-second signal, known as a carry signal to divider circuit 14. The divider circuit which provides the carry signal is referred to as the lower column stage and is the divider circuit which receives the higher frequency signal and produces a lower frequency signal, i.e., the carry signal, which is applied to the upper column stage to thereby effect actuation of the upper column stage.

Figure 2:
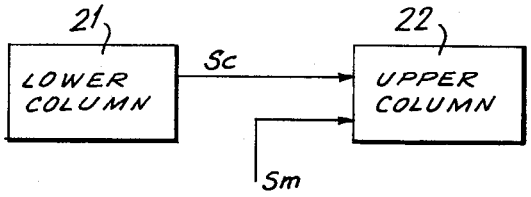
FIG. 2 PRIOR ART
FIG. 2 is a block diagram of a portion of two divider stages of the electronic timepiece of FIG. 1 illustrating the conventional correction arrangement.
Figure 3:
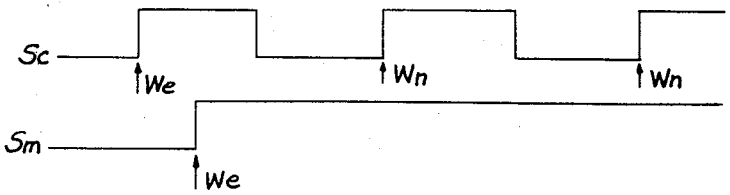
FIG. 3 PRIOR ART
FIG. 3 is a wave diagram corresponding to the circuit of FIG. 2.

Referring now to FIGS. 2 and 3, the prior art method of correcting the timing rate between adjacent divider states is therein illustrated. A carry signal $S_c$ is shown being transmitted from a lower column stage 21 to an upper column stage 22, for example, corresponding to divider circuits 16 and 17 respectively. A signal $S_m$ represents a correction signal selectively applied to the upper column stage, as by the manual manipulation of an external switch such as switches 30, 31, 32 and 33. Each pulse of correction signal $S_m$ is intended to increase the count of upper column stage 22 by one. Since the upper column stage 22 is only actuated when it receives a positive pulse, the application of a correction signal $S_m$ in the form of a positive pulse to the upper column stage 22 during the period of the positive pulse of the carry signal, as shown in FIG. 3, will not result in the desired increase in the count of said upper column stage. Thus, even though a correction signal is applied, the correction of the count of the upper column stage, and therefore the correction of the corresponding digit of the display device is not achieved. Similarly, if the correction signal is added to the upper column counter 22 at a time earlier than the positive pulse $S_c$ representing the carrier pulse applied to the upper column stage, the application of the carry signal $S_c$ will be ineffective and again time correction will not be performed.

Figure 4:
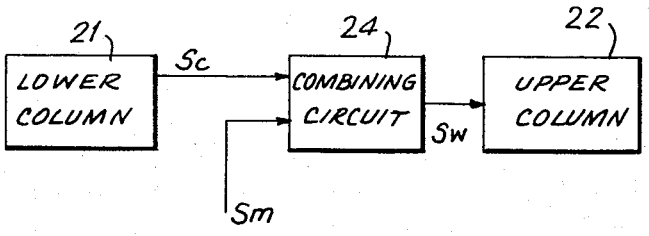
FIG. 4 is a block diagram of two divider stages and a combining circuit for effecting correction in an electronic timepiece.
Figure 5:
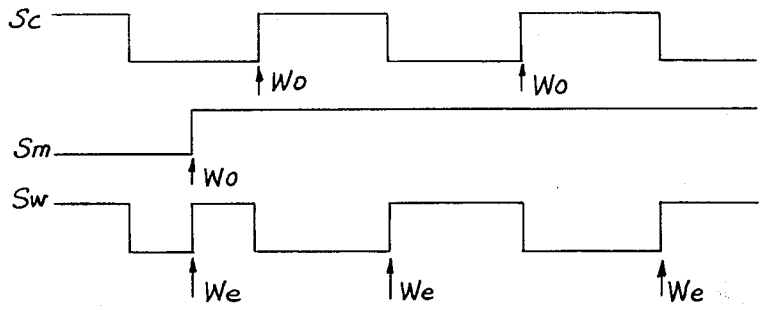
FIG. 5 is a wave diagram corresponding to the circuit of FIG. 4.

Referring now to FIG. 4, there is illustrated therein a combining circuit 24, which circuit receives a carry signal $S_c$ from a lower column stage and a correction signal $S_m$ from an external switch, and combines the signals and supplies a corrected signal $S_w$, as shown in FIG. 5, to the upper column stage. The combining circuit 24 is formed of an electronic logic circuit capable of producing a signal for application to the upper column stage having one pulse for each pulse of carry signal $S_c$ and additionally one pulse for each pulse of correction signal $S_m$, as illustrated, by way of example in FIG. 5.

Figure 6:
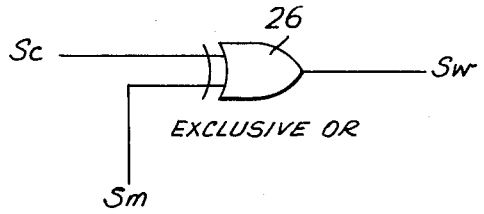
FIG. 6 is a logic block diagram of the principal of the combining circuit of FIG. 4 according to the invention.

One embodiment of combining circuit 24 is the EXCLUSIVE OR gate illustrated in FIG. 6. If the input to the combining circuit 24 are pulses such as carry signal $S_c$, and the correction signal $S_m$ is a rising signal applied at a certain time such as $S_m$, EXCLUSIVE OR gate 26 will only produce a positive pulse in the combined signal $S_w$ at a time when either carry signal $S_c$ is positive or when correction signal $S_m$ is positive, but not when both $S_c$ and $S_m$ are coincidentally positive or negative. Thus, the signal applied to the upper column stage includes one pulse for each pulse of the carry signal and one pulse for each positive excursion of the correction signal so that the count of the upper column stage is corrected by being increased by one for each operation of the external switch (not shown) which produces the correction signal.

In this manner, the count of some or all of divider circuits 13–18 can be individually and surely corrected. A combining circuit 24 would be positioned in the series chain in advance of each divider circuit to be corrected and connected to an external switch means for application of the correction signal thereto. Combining circuits formed of logic elements such as EXCLUSIVE OR gate 26 are of a size that they can be readily assembled as part of the same integrated circuit plate as the dividers associated therewith.

Figure 7:
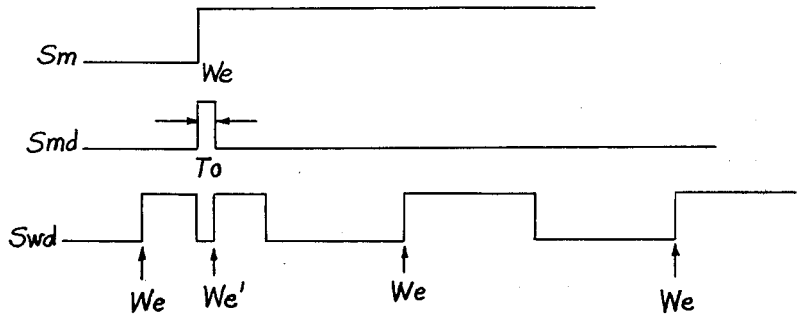
FIG. 7 is a wave diagram of a second embodiment of the combining circuit of FIG. 4.

One difficulty with the arrangement illustrated by the waveform diagram of FIG. 5 is the inversion of the portion of the combined signal $S_w$ after the addition of the positive correction signal $S_m$, which inversion is not corrected until the correction signal returns to a low state. This inversion causes a half-period shift in a portion of the combined signal, which is inconvenient. In order to overcome this difficulty, circuit means could be provided to detect either the rise or fall of the correction signal and convert said correction signal into a single pulse of short duration ($T_o$) as shown in FIG. 7. When the modified correction signal $S_{md}$ is applied to a combining circuit 24 together with a carry signal, a modified combined signal $S_{wd}$ depicted in FIG. 7 is produced. The additional correction pulse is added to the input to the upper column stage without the undesirable half-period shift of the embodiment of FIG. 5.

Figure 8:
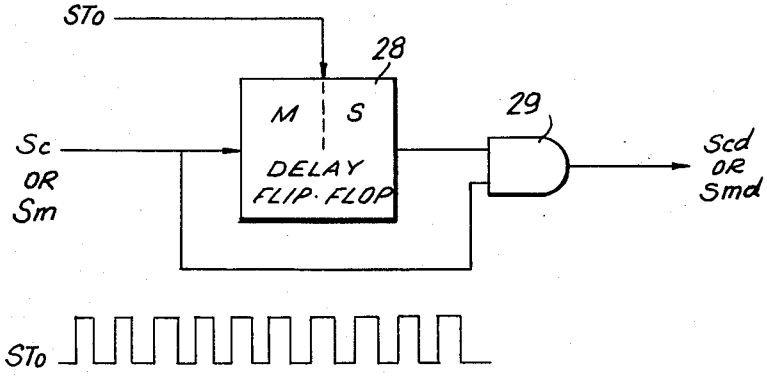
FIG. 8 is an alternate embodiment of a block diagram of circuit means for producing the modified correction signal of the wave diagram of FIG. 7.
Figure 9:
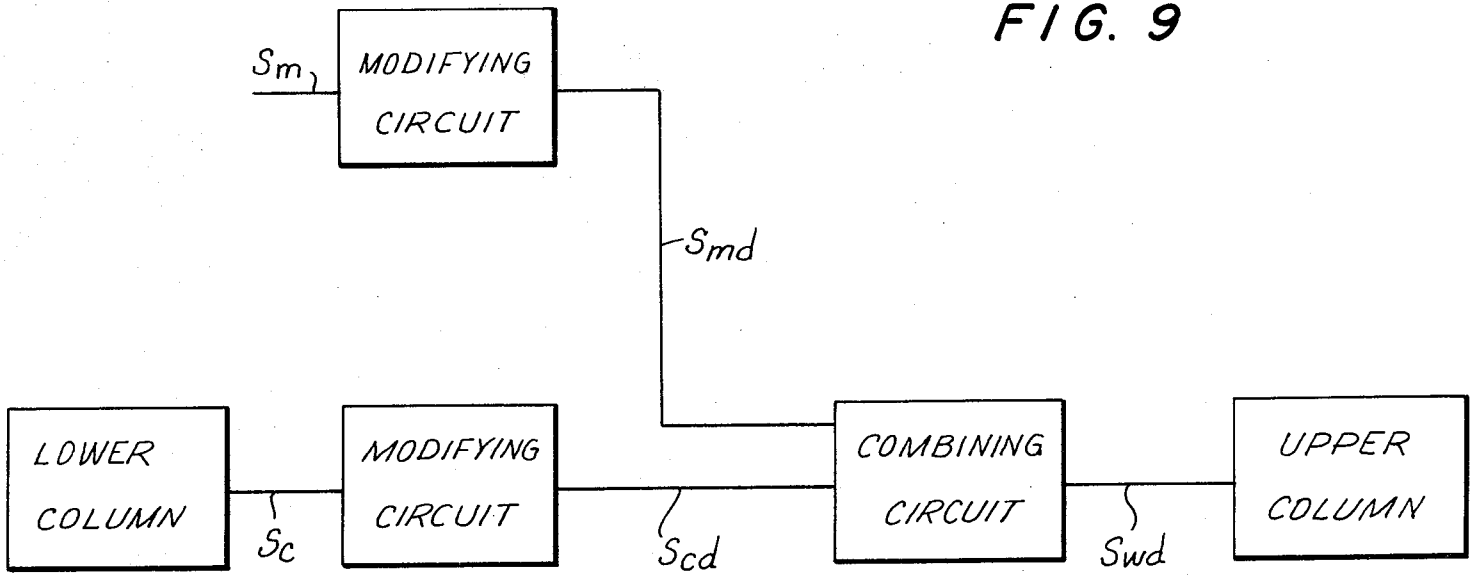
FIG. 9 is a block circuit diagram of one example wherein the modifying circuit depicted in FIG. 8 is utilized in combination with the combining circuit of the instant invention.

In a similar manner, carry signal $S_c$ can be modified into a series of short duration pulses. Either a modified carry signal ($S_{cd}$) or a modified correction signal or both can be applied to combining circuit 24, as is clearly depicted in FIG. 9. The duration ($T_o$) of the pulse of said modified carry and correction signals is preferably of a value which cannot be detected by the eye of a user of the watch, for example, about 1/14 second. FIG. 8 depicts one embodiment of the circuit for modifying the correction or carry signals as described above including a master-slave delay flip-flop 28. The pulse signal $S_{To}$ applied to flip-slop 28 to reset the flip-flop is preferably obtained from the output of a higher frequency divider circuit of said divider chain, thereby avoiding the necessity of providing an oscillator. In the circuit of FIG. 8, either carry signal $S_c$ or correction signal $S_m$ is applied to both delay flip-flop 28 and AND gate 29, the second input to said AND gate being the output of said flip-flop. The output of AND gate 29 is then $S_{cd}$ or $S_{md}$ respectively. The circuit of FIG. 8 can be readily incorporated in a small space on an integrated circuit plate containing the divider circuits.

It will thus be seen that the objects set forth above, and those made apparent from the preceeding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece having oscillator means for producing a high frequency time standard signal, divider means for producing a low frequency timing signal from said high frequency time standard signal including a plurality of series-connected divider stages, and means associated with certain of the divider stages for the digital display of time in response to said timing signals produced by the associated divider stages, the improvement which comprises means for selectively applying a correction signal, and means for correcting one of said certain divider stages in response to said selectively applied correction signal comprising combining circuit means in series connection between the divider stage to be corrected and the next-previous divider stage for receiving the carry signal of said next-previous divider stage and said selectively applied correction signal and for applying as an input to the divider stage to be corrected, a combined signal including a pulse corresponding to each pulse and each of said carry signals and correction signal wherein said combining circuit means is an EXCLUSIVE OR circuit element.

2. In an electronic timepiece having oscillator means for producing a high frequency time standard signal, divider means for producing a low frequency timing signals from said high frequency time standard signal including a plurality of series-connected divider stages, and means associated with certain of the divider stages for the digital display of time in response to said timing signals produced by the associated divider stages, the improvement which comprises means for selectively applying a correction signal, and means for correcting one of said certain divider stages in response to said selectively applied correction signal comprising combining circuit means in series connection between the divider stage to be corrected and the next-previous divider stage for receiving the carry signal of said next-previous divider stage and said selectively applied correction signal and for applying as an input to the divider stage to be corrected, a combined signal including a pulse corresponding to each pulse in each of said carry signal and correction signal and including circuit means for receiving the carry signal from the next-previous stage, for modifying said received signal so that each pulse thereof is of a period shorter than the period of said carry signal and said correction signal, and for applying said modified carry signal to said combining circuit means.

3. An electronic timepiece as recited in claim 2, including one of said signal modifying means for receiving each of said carry signal and said correction signal and for respectively applying said carry signal and correction signal to said combining circuit means.

4. An electronic timepiece as recited in claim 2, wherein said signal modifying means includes a delay flip-flop means adapted to be reset by a signal of a period less than the period of said carry signal and said correction signal.

5. An electronic timepiece as recited in claim 4, wherein said delay flip-flop resetting signal is obtained from a divider stage of a frequency higher than the frequency of the divider stage to be corrected.

6. An electronic timepiece as recited in claim 4, wherein said signal modifying circuit means includes an AND gate having, as a first input, the output of said flip-flop means and, as a second input, the signal applied as the input to said flip-flop means, the output of said AND gate being connected to said combining circuit means.

7. In an electronic timepiece having oscillator means for producing a high frequency time standard signal, divider means for producing low frequency timing signals from said high frequency time standard signal including a plurality of series-connected divider stages, and means associated with certain of the divider stages for the digital display of time in response to said timing signals produced by the associated divider stages, the improvement which comprises means for selectively applying a correction signal, and means for correcting one of said certain divider stages in response to said selectively applied correction signal comprising combining circuit means in series connection between the divider stage to be corrected and the next-previous divider stage for receiving the carry signal of said next-previous divider stage and said selectively applied correction signal and for applying as an input to the divider stage to be corrected, a combined signal including a pulse corresponding to each pulse in each of said carry signal and correction signal and including circuit means for receiving the correction signal, for modifying said received signal so that each pulse thereof is of a period shorter than the period of said carry signal and said correction signal, and for applying said modified correction signal to said combining circuit means.

8. An electronic timepiece as recited in claim 7, wherein said signal modifying means includes a delay flip-flop means adapted to be reset by a signal produced by one of said series-connected divider stages producing a low frequency timekeeping signal having a period less than the period of said carry signal and said correction signal.

9. An electronic timepiece as recited in claim 8, wherein said delay flip-flop resetting signal is obtained from a divider stage of a frequency higher than the frequency of the divider stage to be corrected.

10. An electronic timepiece as recited in claim 8, wherein said signal modifying circuit means incudes an AND gate having, as a first input, the output of said flip-flop means and, as a second input, the signal applied as the input to said flip-flop means, the output of said AND gate being connected to said combining circuit means.

* * * * *